US005089090A

United States Patent [19]

Hansen

[11] Patent Number: 5,089,090

[45] Date of Patent: Feb. 18, 1992

[54] CONTINUOUS CONTROLLED DRAINAGE

[75] Inventor: Victor E. Hansen, Jacksonville, Fla.

[73] Assignee: JWI Ltd., Ontario, Canada

[21] Appl. No.: 661,017

[22] Filed: Feb. 26, 1991

Related U.S. Application Data

[63] Continuation-in-part of Ser. No. 362,926, Jun. 8, 1989, abandoned.

[51] Int. Cl.[5] ..... D21F 1/52; D21F 1/54

[52] U.S. Cl. ..... 162/351; 162/209; 162/352; 162/354; 162/364

[58] Field of Search ..... 162/208, 209, 211, 348, 162/351, 352, 354, 363, 364

[56] References Cited

U.S. PATENT DOCUMENTS

| | | | |
|---|---|---|---|
| 2,881,676 | 4/1959 | Thomas | 162/363 |
| 3,052,296 | 9/1962 | Justus | 162/363 |
| 3,066,068 | 11/1962 | Calehuff et al. | 162/208 |
| 3,149,026 | 9/1964 | Hornbostel | 162/208 |
| 3,311,533 | 3/1967 | Montigny et al. | 162/203 |
| 3,438,854 | 4/1969 | Means | 162/354 |
| 3,981,768 | 9/1976 | Lehtinen | 162/199 |
| 4,046,621 | 9/1977 | Sexton | 162/208 |
| 4,140,573 | 2/1979 | Johnson | 162/352 |
| 4,154,645 | 5/1979 | Kankaanpaa | 162/364 |
| 4,235,667 | 11/1980 | Bergstrom et al. | 162/203 |
| 4,306,934 | 12/1981 | Seppanen | 162/209 |
| 4,734,164 | 3/1988 | Irwin et al. | 162/348 |
| 4,802,954 | 2/1989 | Malashenko | 162/348 |
| 5,011,577 | 4/1991 | Harsen et al. | 162/352 |

*Primary Examiner*—Karen M. Hastings

*Attorney, Agent, or Firm*—Cushman, Darby & Cushman

[57] ABSTRACT

A process and apparatus for improving stock formation on an open surface paper making machine is described. By the use of both a path for the forming fabric which introduces a controlled level of agitation into the stock, and a low level of vacuum in a suction box extending continuously for at least the major proportion of the forming section, improvements both in paper quality, such as improved wire mark, and in machine operation, such as an improved first pass retention, are obtained.

13 Claims, 5 Drawing Sheets

CONTINUOUS CONTROLLED DRAINAGE

RELATED APPLICATION

This application is a Continuation-in-Part of U.S. Pat. application Ser. No. 07/362,926, filed June 8th, 1989 now abandoned.

This invention is concerned with Fourdrinier paper making machines of the type having a "flat wire" or "open wire" forming section, which includes means to remove water from the stock by the use of suction.

In this type of machine, as opposed to "twin wire" machines, or "gap formers", an aqueous slurry known as the stock, which contains both fibers and other substances in an amount of from about 0.1% to 1.5% by weight, is fed from a head box slice onto a single moving forming fabric. Water is progressively removed from the stock through the forming fabric in what is known as the "forming section" of the paper making machine. In this forming section, a variety of drainage devices are used, until the stock contains from about 2% to about 4% by weight of solid material. At that point, the distribution and orientation of the fibers and other solids in the still very wet stock is largely determined, and will not change very much in the remaining paper forming steps unless other devices such as a dandy roll, or "top wire", is brought into contact with the stock. Thus at this point the formation of the paper is largely completed.

In outline, a conventional open wire forming section includes a forming fabric which is supported at the head box slice end by, a breast roll, which is followed in sequence by a "forming board" and a series of drainage devices, which may be drainage foils or table rolls, and suction boxes. More recently, forming sections have included in sequence a forming board, a foil unit and suction boxes of the type described by Johnson, in U.S. Pat. No. 4,140,573. These suction boxes heretofore have been distributed along the length of the forming section with gaps, or undrained spaces, in between them.

Although suction-assisted filter devices are well known, for example as described by Sexton in U.S. Pat. No. 4,046,621, the one reported attempt to use vacuum assisted drainage for the full length of the open wire forming section of a paper making machine appears to have been a failure. Such a paper making machine is described by E.J. Justus in U.S. Pat. No. 3,052,296 (issued in 1962, assigned to Beloit Iron Works). As described by Justus, the forming fabric is to be supported on a "continuous or substantially uninterrupted" series of suction boxes, starting as near to the head box slice as is practicable. These suction boxes are provided with a foraminous surface to support the forming fabric, for which several designs are proposed. Justus proffers several advantages for such a machine: an increase in fiber retention on the forming fabric of up to 70%, as compared to the usual figure of less than about 50%, reduced wire marking on the paper, and "better" paper. A further point made by Justus is that his essentially flat surfaced suction boxes do not cause the phenomenon known as "kick-up" as described in U.S. Pat. No. 2,928,465. When kick-up occurs, what is observed is an essentially vertical movement of both the forming fabric and the stock carried on it in the vicinity of a table roll: this movement can become so violent that it will literally lift the stock off the forming fabric. Such an occurrence is not conducive to the making of good paper.

In a later communication originating from Beloit Iron Works (reported by P. Wrist in "The Formation and Structure of Paper", British Paper and Board Makers Association, London, England, 1962, at pages 863, 864) it is noted that although many of the benefits proffered by the all-vacuum assisted drainage technique proposed by Justus indeed are obtained, nevertheless "the formation of the [paper]sheet deteriorated to an unacceptable level." (Communication to P. Wrist, from Beloit Iron Works). In other words it proved to be impossible to make acceptable quality paper using the modified Fourdrinier paper making machine proposed by Justus. Perhaps as a consequence of this failure, this approach to stock dewatering was not pursued further. Even Justus turned his attention to other methods (e.g. as in U.S. Pat. No. 3,102,066).

The failure of the Justus attempts may be directly attributed to at least two seemingly unrelated causes. First, Justus in setting out to avoid the then known problems of heavy suction and kick-up becoming prevalent with table rolls (and which were becoming a handicap serving to limit paper making speed since as the linear speed of the forming fabric increases the suction and kick-up effects become more violent) endeavoured to eliminate all stock agitation in the forming section.

Second, Justus recommends an applied vacuum such that the pressure in the suction boxes, below the forming fabric, drops from a value close to atmospheric pressure adjacent the head box slice to a value of about two inches of mercury (or about 70 cms of water) below ambient atmospheric pressure at about the 3% point.

It is now known that the reported failure of the Justus machine to make acceptable quality paper is attributable to these two causes. First, Justus endeavoured to eliminate all stock agitation, and second, applied vacuum levels as high as 2 inches of mercury (70 cms water) in order to increase the rate of stock drainage.

It is now known that improved paper formation can be achieved if a level of deliberate agitation is introduced into the stock in the forming section. It has been known for some time that many of the static drainage devices now used to replace table rolls are capable of inducing stock agitation. Such a device, known as the Isoflo (TM) is described by Johnson in U.S. Pat. No. 4,140,573. However, this device, and all other prior art drainage devices that generate some stock agitation have been arranged in the past to do so in an intermittent manner, with quiescent spaces occurring between the drainage devices. The agitation induced in the stock decays rapidly in these spaces between the drainage devices, from a maximum value adjacent the device, to a minimum value ahead of the next drainage device at the end of the space. Because all prior art drainage devices are placed to generate agitation in a cyclical manner, it follows that an undesirably high level must be induced by the devices so as to obtain a satisfactory value over the length of the forming zone.

I have discovered that the the static support element induced areas of agitation in the stock include a whole spectrum of frequencies, and if this agitation is to be effective in countering fiber flocculation within the stock, then a stock agitation pulse rate, or frequency of at least 40 Hz is required, and in many cases, higher pulse rates are desirable. It is not known with any certainty what is the aaximum frequency which will best counter flocculation under all circumstances.

I have now discovered that it is possible to overcome both of these difficulties by using a continuous sequence of Isoflo units, more or less as described by Johnson in U.S. Pat. No. 4,140,573, in a continuous sequence. Compared to the known practise in using these devices, this invention requires that three changes be made which have far reaching consequences. First, the units are all placed in a contiguous, or abutting, relationship with no free spaces in between them. Second, a continuous controlled level of agitation is maintained in the stock, and, if desired, can be so maintained for the full length of the forming section. From this the third change in practise results in that a lower and gentler drainage rate can be used, and therefore the level of applied vacuum can be decreased.

Thus, in a first broad aspect this invention provides a process for improving stock formation on a paper making machine including a moving forming fabric of which at least that portion adjacent the head box slice passes through an open surface forming section, comprising the steps of:

(i) discharging onto the moving forming fabric an aqueous paper making fiber stock across the width of the forming fabric;

(ii) causing the forming fabric to move over a forming section comprising a continuous vacuum assisted suction means provided with a foraminous top support surface for the forming fabric;

(iii) controlling the vacuum in the suction means to a value that rises progressively along the suction means for the length of the forming section from an initial low value of less than 5 cms water gauge adjacent the head box slice to a maximum value of no more than 50 cms water gauge, and (iv) causing a desired level of agitation in the stock on the forming fabric by providing differences in level between different parts of the forming fabric along the length of the forming section.

In a preferred embodiment, the vacuum in the suction means is controlled in such a way that it rises in a stepwise fashion along the length of the forming section, from the initial low value of below 5 cms water gauge to a maximum value of no more than 50 cms water gauge. Desirably there are as many vacuum levels as possible, preferably more than three, and most preferably at least five.

In a second broad aspect this invention provides a paper making machine having an open surface forming section, including at least a travelling continuous forming fabric, which passes over a breast roll adjacent a head box having a head box slice through which aqueous stock is deposited onto the forming fabric, in which forming section the solids content rises from an initial low value as deposited from the head box through the head box slice onto the forming fabric to a value of from about 2% to about 4%, an apparatus for improving paper formation consisting essentially of in combination:

(a) a suction means located beneath the forming fabric and extending from a point adjacent the head box slice to the end of the forming section;

(b) a foraminous support surface for the forming fabric on the suction means; and (c) a vacuum pump means including vacuum control means, whereby the level of vacuum in the suction means is controlled; wherein:

(i) the suction means comprises either a single suction box divided into a plurality of separate chambers by a plurality of vacuum tight divisions extending across the width of the suction box, and each chamber is provided with both a separate vacuum control means and a separate drainage means, or a plurality of contiguously adjacent suction boxes each of which is provided separately with both a vacuum control means and a drainage means;

(ii) the foraminous support comprises a series of spaced apart forming fabric supporting blades having a generally planar top surface transverse to the direction of travel of the forming fabric in a common essentially horizontal plane providing therebetween suction accessible gaps in which the forming fabric is substantially unsupported and is drawn downward to form stock agitating undulations in the gaps, the surface including water seal forming blades disposed intermediately in the gaps between the fabric supporting blades, and having a top surface transverse to the direction of travel of the forming fabric at a lower level than the top surface of the forming fabric supporting blades and at least forming water seals at the downward undulations in the forming fabric, together with sealing strips interposed between the ends of the blades adjacent the lateral edges of the forming fabric;

(iii) the fabric supporting blades in the foraminous support surface are regularly spaced to generate a continuous controlled level of agitation in the stock on the forming fabric; and (iv) a forming fabric supporting blade in the foraminous support surface is located substantially above both either a transverse vacuum tight division, or a pair of contiguous transverse walls in the suction means, and each of the first and the last walls in the suction means in the forming section, thereby providing a vacuum tight seal across the width of the forming fabric between the evacuated parts of the suction means in the forming section.

The suction means preferably comprises a sequence of separated drainage chambers, to each of which a controlled level of vacuum is applied, rising stepwise from a level of no more than 5 cms water gauge below ambient atmospheric pressure adjacent the head box slice to no more than 50 cms water gauge at the other end of the suction box, that is at the other end of the forming section.

In certain circumstances it is contemplated that it may not be either practicable or desirable to utilize vacuum assisted drainage over the full length of an open surface forming section, however the basic concepts of this invention can still be used in paper making machines wherein the vacuum assisted section is preceded by a short dewatering section using other static dewatering devices.

In a third broad aspect this invention provides in a paper making machine having an open surface forming section including at least a continuous travelling forming fabric, which passes over a breast roll adjacent a head box having a head box slice through which aqueous stock is deposited onto the forming fabric, in which forming section the solids content of the stock rises from an initial low value as deposited from the head box through the head box slice, to a value of from about 2% to about 4%, an apparatus for improving paper formation consisting essentially of in combination:

(a) a relatively short foraminous dewatering device adjacent the head box slice which includes a plurality, of stationary stock drainage elements disposed in supporting relationship substantially of the forming fabric;

(b) a suction means located beneath the forming fabric and extending from a point adjacent the end of the short foraminous dewatering device to the end of the forming section;

(c) a foraminous support surface for the forming fabric on the suction means; and (d) a vacuum pump means including vacuum control means, whereby the level of vacuum in the suction means is controlled; wherein:

(i) the suction means comprises either a single suction box divided into a plurality of separate chambers by a plurality of vacuum tight divisions extending across the width of the suction box, and each chamber is provided with both a separate vacuum control means and a separate drainage means, or a plurality of contiguously adjacent suction boxes each of which is provided separately with both a vacuum control means and a drainage means;

(ii) the foraminous support surface comprises a series of spaced apart forming fabric supporting blades having a generally planar top surface transverse to the direction of travel of the forming fabric in a common essentially horizontal plane providing therebetween suction accessible gaps in which the forming fabric is substantially unsupported and is drawn downward to form stock agitating undulations in the gaps, the surface including water seal forming blades disposed intermediately in the gaps between the fabric supporting blades, and having a top surface transverse to the direction of travel of the forming fabric at a lower level than the top surface of the forming fabric supporting blades and at least forming water seals at the downward undulations in the forming fabric, together with sealing strips interposed between the ends of the blades adjacent the lateral edges of the forming fabric;

(iii) the fabric supporting blades in the foraminous support surface are regularly spaced to generate a controlled level of harmonic periodic agitation in the stock on the forming fabric; and (iv) a forming fabric supporting blade in the foraminous support surface is located substantially above both either a transverse vacuum tight division, or a pair of contiguous transverse walls in the suction means, and each of the first and the last walls of the suction means in the forming section, thereby providing a vacuum tight seal across the width of the forming fabric between the evacuated parts of the suction box in the forming section.

Further, in a fourth broad aspect this invention provides a process for improving stock formation on a paper making machine including a moving forming fabric of which at least that portion adjacent the head box slice passes through an open surface forming section, comprising the steps of:

(i) discharging onto the moving forming fabric an aqueous paper making fiber stock across the width of the forming fabric;

(ii) causing the forming fabric to move over a relatively short foraminous dewatering device adjacent the head box slice which includes a plurality of stationary drainage elements disposed in a supporting relationship transversely of the forming fabric;

(iii) thereafter causing the forming fabric to move over a continuous vacuum assisted suction means provided with a foraminous top support for the forming fabric and which extends for the remainder of the length of the forming section;

(iv) controlling the vacuum in the suction means to a value that rises progressively along the length of the suction means from an initial value of less than 5 cms water gauge adjacent the short foraminous dewatering device to a maximum value of no more than 50 cms water gauge at the end of the forming section; and (v) causing a desired level of agitation in the stock on the forming fabric by providing differences in level between different parts of the forming fabric along the length of the suction means.

In yet another refinement of these broad apparatus and process aspects of this invention it is also contemplated that the short foraminous dewatering device can also provide a path for the forming fabric affecting the level of agitation in the stock before it reaches the foraminous surface on the suction box. The short foraminous dewatering device can include both a forming board adjacent to the head box slice, and a foil section (between the forming board and the suction box), wherein the foil section may comprise up to four fifths of the dewatering device drained area.

The blade-to-blade spacing for the upper fabric supporting blades in the Isoflo units must be chosen so as to realize two objectives: first, the stock agitation frequency obtained in any given area of the forming section should be sufficient to improve formation, and second, the agitation should be continuous for the full length of the forming section, with no areas in which the agitation is allowed to decay to an undesirably low value. By carefully selecting the support element spacing, the level of stock agitation at any point on the forming fabric can be enhanced, maintained or diminished.

One of the key benefits of this invention over the prior art is that a continuous controlled level of agitation is more easily generated and maintained in the stock. Once this is achieved, then the vacuum forces used to generate and maintain this agitation can be reduced which, in turn, will reduce the drainage forces on the stock. Because the drainage of the stock takes place through the paper mat being formed, and because this mat is compressible, the use of a lower level of applied vacuum results in lower mat compression and, therefore, lower mat resistance to drainage.

A further key benefit of this invention is that more than expected drainage occurs at these lower vacuum levels. In order to realize the benefits of this invention, both the gentle agitation and the gentle drainage must be maintained and controlled over the full length of the forming zone. When Isoflo units are brought together into a contiguous relationship, then this may be accomplished.

A further benefit of this arrangement is that because drainage is now continuous over the whole length of the forming section, with no undrained areas between Isoflo units, there are no areas subjected to unnecessarily high drainage values. This reduces the amount of local drainage required at any one point in the forming section. Hence, if successive Isoflo units utilize only the very minimum of vacuum, then an improved drainage rate occurs. The direct benefit of reduced drainage forces is a reduction in the velocity of the water draining from the stock through both the mat and the forming fabric. This results in the further benefits of reduced wire mark, an increase in solds retention in the mat and easier dewatering of the mat in the successive dewatering stages. Further, as a direct consequence of the continuously induced agitation, better fiber distribution in the paper mat is obtained.

The invention will now be described by way of reference to the attached drawings in which.

In these Figures, relevant like parts have been given the same numbers.

Figure 1:
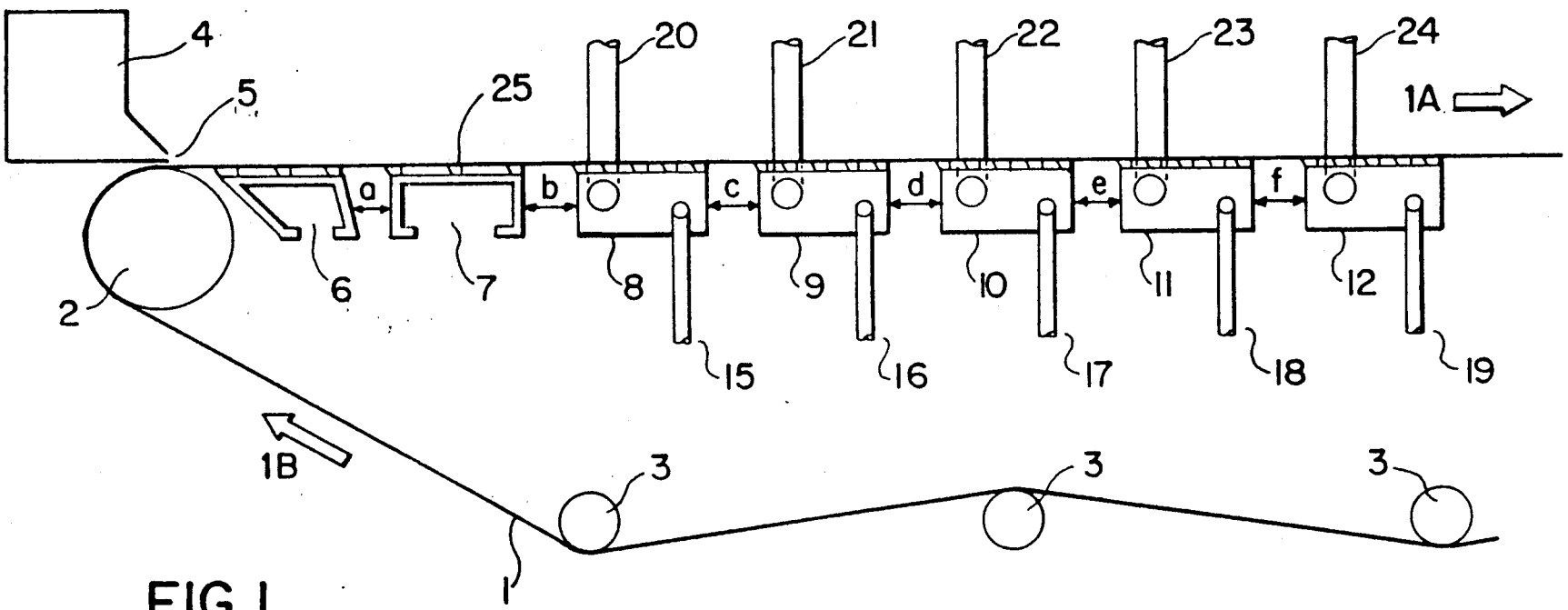
FIG. 1 (PRIOR ART)
FIG. 1 shows diagrammatically the initial part of a prior art paper making machine.

In FIG. 1, the forming section of a paper making machine is shown, incorporating a forming fabric 1, which moves in the direction of the arrows shown at 1A and 1B. The forming fabric moves over a breast roll 2, and various tensioning and idling rollers 3. The stock is deposited onto the forming fabric 1 from the head box shown diagrammatically at 4, through a slice 5, which extends across the forming fabric 1. Beneath the forming fabric in the forming section are placed a sequence of drainage devices 6, 7, 8, 9, 10, 11 and 12, provided with white water drains 15, 16, 17, 18 and 19. The first of these drainage devices, 6, comprises a forming board, the second, 7, comprises an open foil unit, and the remainder are so-called Isoflo units (Trade Mark). Boxes 8 to 12 are also provided with a controlled vacuum, through the vacuum pipes 20, 21, 22, 23 and 24 respectively. The vacuum applied will typically range from zero to 5 cms water gauge in box 8, to no more than 50 cms water gauge in box 12; the white water drains 15, 16, 17, 18 and 19 contain suitable vacuum means. A key feature, from the aspect of this invention, is that not all of the forming section is being actively drained. The drainage and suction boxes are separated by the spans marked a, b, c, d, e and f which represent undrained areas. In the machine shown, these spans represent nearly 30% of the total area of the forming section.

In this machine, which is typical of existing prior art machines, three different forms of drainage element are used, in sequence away from the head box slice 5. The first of these is a set of conventional flat forming board blades associated with box 6.

Figure 2:
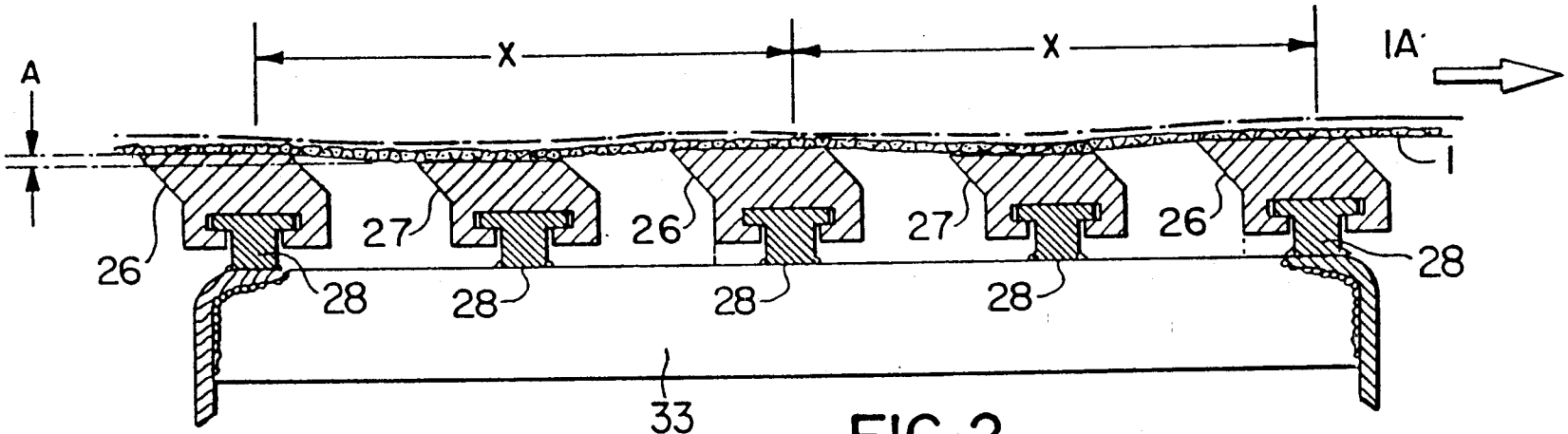
FIG. 2 (PRIOR ART)
FIG. 2 shows a so-called Isoflo unit; .

In box 7 the drainage elements 25 are conventional foil blades broadly conforming to the design shown by Wrist in U.S. Pat. No. 2,928,465, mounted on the now-commonly used T-bar arrangement of White, et al in U.S. Pat. No. 3,337,394. In boxes 8 through 12 a so-called Isoflo unit is used, which is described in detail in Johnson, U.S. Pat. No. 4,140,573. FIG. 2 (which corresponds broadly to Johnson's FIG. 4), and shows two groups of static devices 26 and 27. Devices 26 and 27 are each supported on a tee-bar 28; these tee bars 28 are supported across the width of the box by suitably placed supports 33. The top faces of all of these devices are generally planar and either in the plane of the forming fabric (devices 26) or a little below it (devices 27). As shown in FIG. 2 the vertical lowering of the devices 27 is indicated at A, which is exaggerated for clarity. In practice, this distance generally will range from about 0.5 mm to about 5.0 mm. The forming fabric in moving over such a foraminous surface undulates between successive devices 26, and the intervening devices 27 which are so placed vertically as to provide a water seal to the underside of the forming fabric. Sealing elements, not shown, are also provided along the sides of the boxes in between the drainage devices, parallel to the sides of the forming fabric. Water is drawn from the stock through the forming fabric by the application of vacuum to the box.

It is a feature of this invention that the path through which the forming fabric moves over the static drainage devices whilst the stock is still highly fluid is designed and constructed to provide a continuous and controlled level of agitation in the stock, up to the point where the consistency rises to a value between about 2% and 4%. At this level of consistency, paper formation is effectively completed. The required agitation is created by the static dewatering devices, and controlled by careful choice of dewatering device configuration, and the applied vacuum level.

Figure 3:
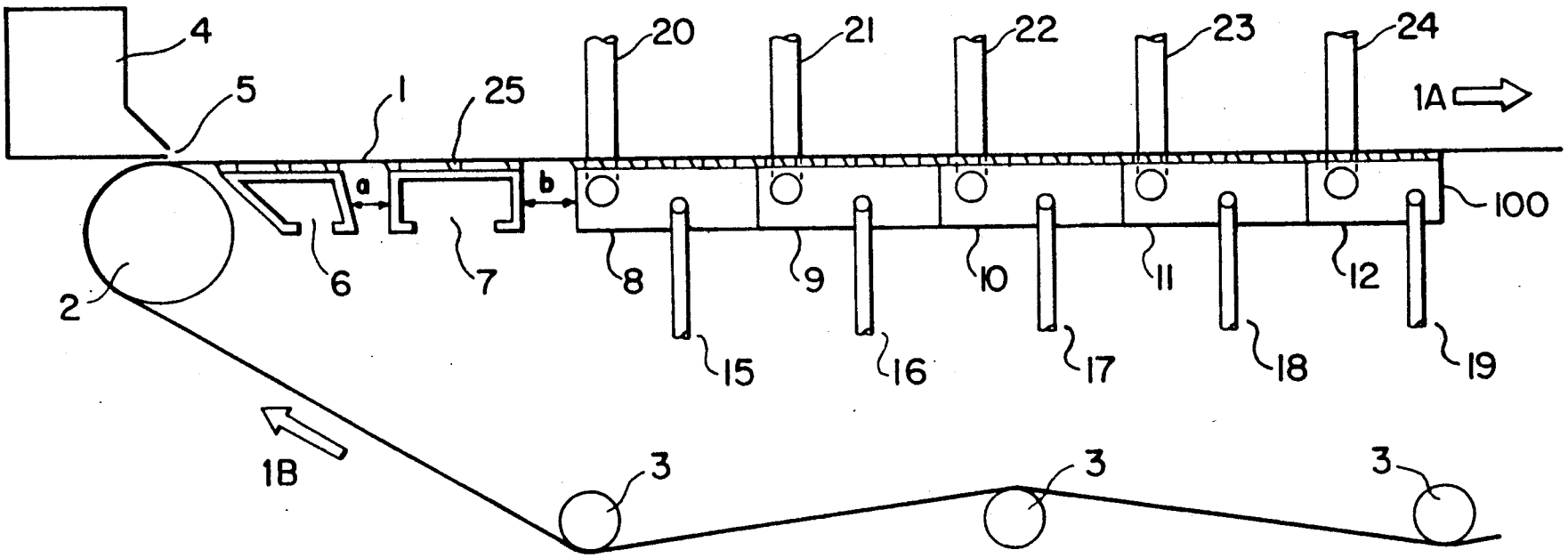
FIG. 3 shows diagrammatically a paper making machine modified according to one aspect of this invention.

It is known that an Isoflo works best when the upper fabric supporting blades 26 are regularly spaced, as shown by the distance X in FIG. 3. Historically, it has also been recommended that a group of Isoflo units when placed in sequence will work best when all of the upper fabric supporting blades 26 are the same distance apart, thus calling for the gaps c through f to be constant and to be such that the support blade spacing between the last blade 26 of one unit to the first blade 26 in the next is the same as the gap within the unit.

FIG. 3 shows essentially the same portion of a paper making machine as is shown in FIG. 1, but utilizing one embodiment of this invention. In common with FIG. 1, the forming fabric 1 passes over the rollers 3, around the breast roll 2, and then past the head box slice 5, at which point the stock is deposited onto it. Drainage is initiated by the forming board section on box 6, and continued by the foils associated with box 7; it is to be noted that boxes 6 and 7 are still separated by the gap a.

Figure 4:
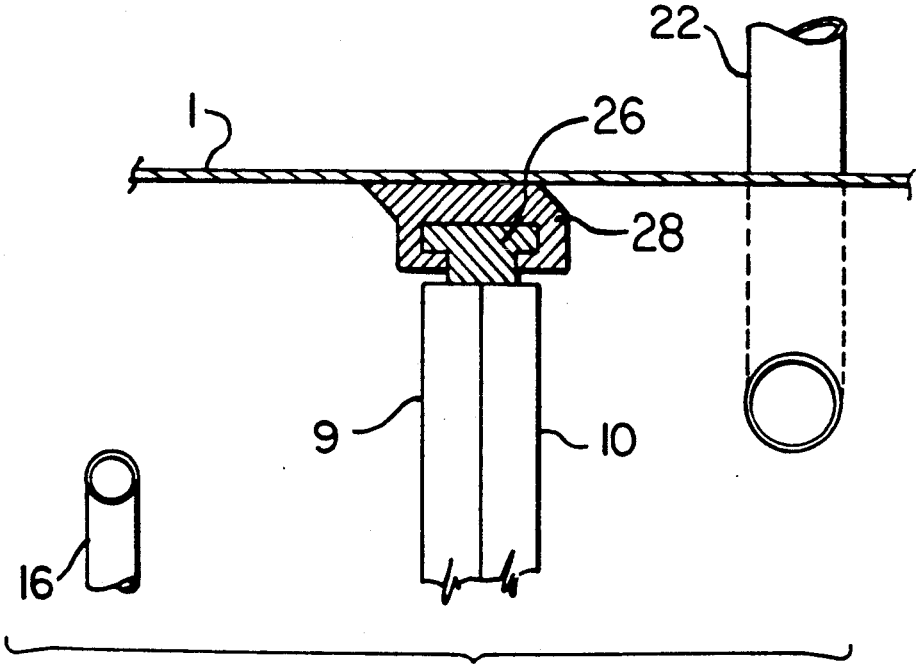
FIG. 4 shows a detail of both FIG. 3 and FIG. 5.

The remainder of the forming section comprises a single extended suction box 100, which is separated into the sequence of separate chambers 8, 9, 10, 11 and 12, either by using a single continuous suction box with dividers, or by using a plurality of smaller boxes, butting up closely to each other. These suction units also differ from the arrangement shown in FIG. 2 in another way. In that figure, the first support surface 26 is an upper one, and is followed by a lower one, 27. As described by Johnson in U.S. Pat. No. 4,140,573, and shown in FIG. 2, the last support surface in the box is also an upper one. When a sequence of boxes of this type are brought into the contiguous relationship of this invention, one of these surfaces becomes redundant, since the last support surface in any one box also becomes the first support surface for the next one, as is shown in FIG. 4.

In FIG. 3, two gaps still remain between the drainage units; these are gaps a and b. Gap b can be eliminated by extending the suction box into this gap, so that the drainage chamber 7 and the first compartment 8 in the suction box 100 become contiguous. If that step is taken, then the last foil blade on the box 7 become redundant.

Since it is not appropriate to use a foil blade as the first forming fabric support surface in an Isoflo unit. It is also advantageous, in machines where a forming board and foil unit are retained, to space the foils, at least, so that they too contribute to continuous controlled agitation in the stock.

Figure 5:
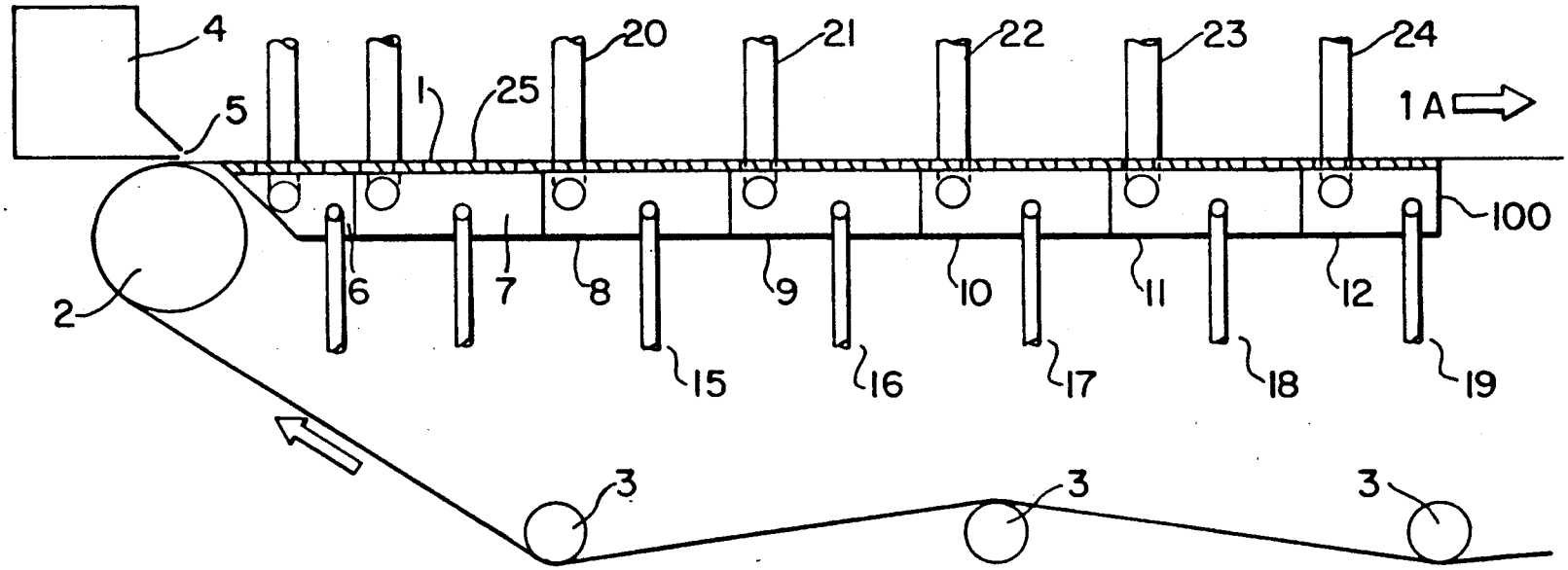
FIG. 5 shows an alternative construction to that of FIG. 3.

In a similar fashion, the ability to control the drainage and level of agitation in the stock will be improved if the gap a is also eliminated. As shown in FIG. 5, the foil unit 7 and the forming board unit 6 can be removed, and the suction box 100 extended to a point adjacent the breast roll 2, so that the only drainage unit used in the forming section is a sequence of contiguous Isoflo units.

In practice, there are two ways in which such an extended suction box can be obtained: an existing row of Isoflo units can be moved laterally so as to be brought together, which would have the effect of shortening the forming section, or alternatively, as is shown in FIG. 5 the suction box 100 can be lengthened suitably, which has the effect of maintaining the length of the forming section. Moving the Isoflo units has two disadvantages. The first is that it will leave an equivalent length of the overall machine unused, corresponding to the eliminated gaps. The second is that shortening the length of the forming section means that the water is being removed more rapidly from the stock. It is recommended that the length of the forming section should be retained, since this will reduce the rate at which the stock is being drained and will maximize the length over which a controlled level of agitation can be maintained. Decreasing the drainage rate generally improves the quality of the paper being made, since better paper mat formation occurs and wire marking is lessened.

One further feature of the arrangement in FIGS. 3 and 5 deserves comment. The units 8 through 12 are Isoflo units corresponding essentially to the configuration in FIG. 3. As shown in FIG. 2, within each Isoflo unit the upper blades 26 will be regularly spaced. The spacing will be chosen to induce agitation (as explained earlier) at a pulse frequency of at least 40 Hz in each unit. However, it does not follow that all of the contiguous Isoflo units will utilize the same value of X for the upper blade separation. Some fabric support blades might, in a typical machine, be set at the spacing needed for 40 pulses/sec; others may be set at 80 pulses/sec or even 160 pulses/sec. The pulse rate chosen, which is to say the value of X that is chosen, will depend on the nature of the agitation it is desired to induce in the stock on the forming fabric at any given point.

A very convenient way in which to acquire the blade spacings needed for this invention is to utilize the T-bar construction methods of White et al, U.S. Pat. No. 3,337,394. It is required that although the static support surfaces 26 in the Isoflo units will all be regularly spaced, they will not all necessarily be at the same spacings. It is presently contemplated that the spacings will always be integral multiples of each other: that is the spacing for 120 Hz can be changed to 40 Hz, or 60 Hz simply by removing blades from their supporting T-bars. Thus, by selection of a T-bar spacing corresponding to the highest pulsing frequency contemplated, other lower frequencies can be easily obtained.

What is claimed is:

1. In a paper making machine having an open surface forming section, including at least a travelling continuous forming fabric, which passes over a breast roll adjacent a head box having a head box slice through which aqueous stock is deposited onto the forming fabric, in which forming section the solids content rises from an initial low value as deposited from the head box through the head box slice onto the forming fabric to a value of from about 2% to about 4%, an apparatus for improving paper formation consisting essentially of in combination:

(a) a suction means located beneath the forming fabric and extending from a point adjacent the head box slice to the end of the forming section;

(b) a foraminous support surface for the forming fabric on the suction means; and (c) a vacuum pump means including vacuum control means, whereby the level of vacuum in the suction means is controlled; wherein:

(i) the suction means comprises either a single suction box divided into a plurality of separate chambers by a plurality of vacuum tight divisions extending across the width of the suction box, and each chamber is provided with both a separate vacuum control means and a separate drainage means, or a plurality of contiguously adjacent suction boxes each of which is provided separately with both a vacuum control means and a drainage means;

(ii) the foraminous support comprises a series of spaced apart forming fabric supporting blades having a generally planar top surface transverse to the direction of travel of the forming fabric in a common essentially horizontal plane providing therebetween suction accessible gaps in which the forming fabric is substantially unsupported and is drawn downward to form stock agitating undulations in the gaps, the surface including water seal forming blades disposed intermediately in the gaps between the fabric supporting blades, and having a top surface transverse to the direction of travel of the forming fabric at a lower level than the top surface of the forming fabric supporting blades and at least forming water seals at the downward undulations in the forming fabric, together with sealing strips interposed between the ends of the blades adjacent the lateral edges of the forming fabric;

(iii) the fabric supporting blades in the foraminous support surface are regularly spaced to generate a continuous controlled level of agitation at a pulse frequency of at least 40 Hz in the stock on the forming fabric, and wherein the blades are provided with mounting means, the mounting means being structured and arranged to provide for a pulse frequency of up to at least 120 Hz, so that the blades can be spaced to provide a pulse frequency of from at least 40 Hz to up to at least 120 Hz. and (iv) a forming fabric supporting blade in the foraminous support surface is located substantially above both either a transverse vacuum tight division, or a pair of contiguous transverse walls in the suction means, and each of the first and the last, walls in the suction means in the forming section, thereby providing a vacuum tight seal across the width of the forming fabric between the evacuated parts of the suction means in the forming section.

2. An apparatus according to claim 1 wherein the fabric supporting blades in the foraminous support surface are all regularly spaced at the same spacing.

3. An apparatus according to claim 1 wherein the fabric supporting blades in the foraminous support surface are in contiguous groups, and wherein the regular spacing of the blades within any one group is not the same as the regular spacing of the blades in an adjacent group.

4. In a paper making machine having an open surface forming section including at least a continuous travelling forming fabric, which passes over a breast roll adjacent a head box having a head box slice through which aqueous stock is deposited onto the forming fabric, in which forming section the solids content of the stock rises from an initial low value as deposited from the head box through the head box slice, to a value of from about 2% to about 4%, an apparatus for improving paper formation consisting essentially of in combination:

(a) a relatively short foraminous dewatering device adjacent the head box slice which includes a plurality of stationary stock drainage elements disposed in supporting relationship substantially of the forming fabric, and which includes at least one drainage chamber;

(b) a suction means located beneath the forming fabric and extending from a point adjacent the end of the short foraminous dewatering device to the end of the forming section;

(c) a foraminous support surface for the forming fabric on the suction means; and (d) a vacuum pump means including vacuum control means, whereby the level of vacuum in the suction means is controlled;

wherein:

(i) the suction means comprises either a single suction box divided into a plurality of separate chambers by a plurality of vacuum tight divisions extending across the width of the suction box, and each chamber is provided with both a separate vacuum control means and a separate drainage means, or a plurality of contiguously adjacent suction boxes each of which is provided separately with both a vacuum control means and a drainage means;

(ii) the foraminous support surface comprises a series of spaced apart forming fabric supporting blades having a generally planar top surface transverse to the direction of travel of the forming fabric in a common essentially horizontal plane providing therebetween suction accessible gaps in which the forming fabric is substantially unsupported and is drawn downward to form stock agitating undulations in the gaps, the surface including water seal forming blades disposed intermediately in the gaps between the fabric supporting blades, and having a top surface transverse to the direction of travel of the forming fabric at a lower level than the top surface of the forming fabric supporting blades and at least forming water seals at the downward undulations in the forming fabric, together with sealing strips interposed between the ends of the blades adjacent the lateral edges of the forming fabric;

(iii) the fabric supporting blades in the foraminous support surface are regularly spaced to generate a continuous controlled level of agitation at a pulse frequency of at least 40 Hz in the stock on the forming fabric, and wherein the blades are provided with mounting means, the mounting means being structured and arranged to provide for a pulse frequency of up to at least 120 Hz, so that the blades can be spaced to provide a pulse frequency of from at least 40 Hz to up to at least 120 Hz; and (iv) a forming fabric supporting blade in the foraminous support surface is located substantially above both either a transverse vacuum tight division, or a pair of contiguous transverse walls in the suction means, and each of the first and the last walls of the suction means in the forming section, thereby providing a vacuum tight seal across the width of the forming fabric between the evacuated parts of the suction means in the forming section.

5. An apparatus according to claim 4 wherein the fabric supporting blades in the foraminous support surface are all uniformly spaced at the same spacing.

6. An apparatus according to claim 4 wherein the fabric supporting blades in the foraminous support surface are in contiguous groups, and wherein the regular spacing of the blades within any one group is not the same as the regular spacing of the blades in an adjacent group.

7. An apparatus according to claim 4 wherein adjacent the head box slice the stock dewatering device includes a forming board having at least one stationary stock drainage element.

8. An apparatus according to claim 4 wherein the short dewatering device includes a foil section.

9. An apparatus according to claim 8 wherein the short dewatering device includes:

(i) a forming board unit adjacent the head box slice including at least one static drainage element; and (ii) a foil section placed between the forming board and the suction box, including at least one foil.

10. An apparatus according to claim 8 wherein the foil section drainage chamber is contiguous with the suction means, and wherein a fabric supporting blade of the foraminous support surface on the suction means is placed substantially over the contiguous transverse walls of the foil section drainage chamber and the suction means.

11. An apparatus according to claim 9 wherein the foil section drainage chamber is contiguous with the suction means, and wherein a fabric supporting blade of the foraminous support surface on the suction means is placed substantially over the contiguous transverse walls of the foil section drainage chamber and the suction means.

12. An apparatus according to claim 8 wherein in the foil section the foils contribute toward the continuous controlled agitation of the stock.

13. An apparatus according to claim 9 wherein in the foil section the foils contribute toward the continuous controlled agitation of the stock.

* * * * *